US005108115A

United States Patent [19]

Berman et al.

[11] Patent Number: 5,108,115

[45] Date of Patent: Apr. 28, 1992

[54] INTERACTIVE GAME SHOW AND METHOD FOR ACHIEVING INTERACTIVE COMMUNICATION THEREWITH

[76] Inventors: Robert Berman; Carmen Berman, both of 16 Silvermine Woods, Wilton, Conn. 06897

[21] Appl. No.: 597,003

[22] Filed: Oct. 15, 1990

Related U.S. Application Data

[63] Continuation-in-part of Ser. No. 447,884, Dec. 7, 1989, Pat. No. 5,035,422.

[51] Int. Cl.[5] ..... A63F 9/22; A63F 9/18

[52] U.S. Cl. ..... 273/439; 273/430; 273/431; 273/254; 273/252; 434/130

[58] Field of Search ..... 273/250, 251, 252, 253, 273/254, 429, 430, 431, 439, 141 R, 141 A, 142 R; 434/130, 131, 135, 146, 323; 455/2; 358/84

[56] References Cited

U.S. PATENT DOCUMENTS

| | | | |
|---|---|---|---|
| 1,561,402 | 11/1925 | Bernwall | 273/252 |
| 2,654,163 | 10/1953 | Reynolds | 273/429 |
| 4,586,707 | 5/1986 | McNeight et al. | 273/430 |
| 4,745,468 | 5/1988 | Von Kohorn | 434/323 |
| 4,807,878 | 2/1989 | Tripp | 273/431 |
| 4,845,739 | 7/1989 | Katz | 379/92 |
| 4,876,592 | 10/1989 | Von Kohorn | 434/323 |
| 4,926,255 | 5/1990 | Von Kohorn | 434/323 |
| 4,958,837 | 9/1990 | Russell | 273/237 |
| 4,969,183 | 11/1990 | Reese | 273/138 R |

FOREIGN PATENT DOCUMENTS

| | | | |
|---|---|---|---|
| 2211750 | 7/1989 | United Kingdom | 273/254 |

*Primary Examiner*—Edward M. Coven
*Assistant Examiner*—Jessica J. Harris
*Attorney, Agent, or Firm*—Melvin I. Stoltz

[57] ABSTRACT

By providing an interactive communication system whereby individuals are able to electronically select at least one possible outcome of a plurality of outcomes of a future event, individuals are able to participate in the outcome of that event and possibly share in a prize award associated with the event. In the preferred embodiment, individuals forming the home audience of a televized game show are able to electronically communicate a series of random numbers using their telephone to participate in possibly winning the prize awards of the show. In addition, both on-camera game participants and the studio audience also participate and have the ability to win prizes.

20 Claims, 3 Drawing Sheets

INTERACTIVE GAME SHOW AND METHOD FOR ACHIEVING INTERACTIVE COMMUNICATION THEREWITH

RELATED APPLICATION

This application is a continuation-in-part patent application of U.S. Ser. No. 07/447,884, filed Dec. 7, 1989, now U.S. Pat. No. 5,035,422.

TECHNICAL FIELD

This invention relates to game shows particularly suited for television and, more particularly, to television game shows wherein both the studio audience and the home viewing audience are able to actively participate in the game show with the ability to win prize awards.

BACKGROUND ART

Throughout the years of television broadcasting, game shows have been popular programs employed by all of the competing stations and networks in order to attract viewers. Many of these game shows have become very popular with the viewing audience and have enjoyed many years of continuous, regular broadcasting.

Over the years, many new game shows have been created in an attempt to achieve the level of success that has been attained by popular shows. In order to entice and maintain a large audience base, the new shows have employed a wide variety of formats and themes. However, in spite of the extraordinary effort that has been expended in developing new popular game shows and game show formats, no program has been able to attain a high level of direct, real interaction between the game show itself and the home viewing audience.

In particular, viewers are only able to participate in the game show action amongst themselves, without being able to share in the prize awards given to the on-camera participants. As a result, viewers have become bored and ultimately stop watching these shows.

In addition to the prior art failure to directly involve the home viewing audience in immediate, timely, interactive participation in the game show itself, prior art systems and game shows have also failed to achieve a format wherein the home audience is able to share in a prize award in a manner which is convenient and completely uncontrolled by the producers of the game show. In general, any prior art attempts to involve the home viewing audience have required the home viewers to mail in postcards which are then randomly selected to potentially allow one individual to win a prize award.

Such participation has failed to capture the interest of most viewers, since the selection of any home viewer participant is completely at the control of the game show producers. In addition, the selection of one participant from the vast number of submissions received makes the likelihood of being selected extremely remote.

In addition to these prior art game show failures with the home viewer, prior art game shows have also failed to directly involve the studio audience in a manner which would allow the studio audience, in its entirety, to actively participate in the game show by having an equal chance of winning prize awards. At best, prior art game shows have selected participants from the audience, who become the on-camera game participants. However, once the participants have been selected, the remaining studio audience become observers and are unable to participate in winning any prize awards.

Therefore, it is a principal object of the present invention to provide a game show system which allows home viewers to actively participate in predicting a future outcome of a game show and sharing a prize award, if correct.

Another object of the present invention is to provide a game show system having the characteristic features described above wherein on-camera participants, the studio audience, and the home viewing audience all participate in pre-selecting potential winning outcomes, with any individual properly predicting the winning outcome being awarded a prize.

Another object of the present invention is to provide a game show system having the characteristic features described above wherein the home audience is capable of directly, interactively participating in the actual game, thereby enhancing audience interest and excitement.

Another object of the present invention is to provide a game show system having the characteristic features described above wherein the future, prize-determining event is completely random and is out of the control of the game show producers.

A further object of the present invention is to provide an interactive communication system whereby individuals are able to independently select at least one possible outcome of a future event and participate in winning a prize award if their prediction is accurate by employing electronic communication, without leaving their home.

Another object of the present invention is to provide a game show system having the characteristic features described above which employs the interactive communication system described above to allow home viewers to participate in the televised game using their own home telephones.

Other and more specific objects will in part be obvious and will in part appear hereinafter.

SUMMARY OF THE INVENTION

The present invention completely eliminates the prior art drawbacks and difficulties by providing a new, unique game show system which enables on-camera game participants to win prizes, while also enabling active participation by both the studio audience and the home viewing audience. In the preferred embodiment, the game is based upon the selection of a set of numbers which are randomly picked from a pool of fixed numbers, similar to the arrangement employed in state-run lottery games. Due to the completely random, uncontrolled manner in which a prize winning number set is obtained, total confidence in the uncontrolled nature of the game prize award is achieved.

In the present invention, three levels of participation are provided. First, on-camera game contestants compete with each other to earn the particular numbers each contestant desires to form their personal number set. Preferably, prizes are also able to be won by the contestants during this active competition.

Second, the live audience is allowed to participate by completing a game card on which each individual provides his personal selection for the final winning set of numbers. Any participant correctly predicting the game show's final set of numbers will be awarded a pre-determined prize or share in the pre-determined jackpot.

Finally, the home viewing audience is also able to actively participate and share in the prizes being awarded. In the preferred embodiment, the home viewers participate by using their telephones to call a pre-advertised number. Once connected, the viewer transmits to the receiving station that individual's personal selection for the winning set of numbers. Any viewer who correctly predicts the final number set receives or shares the prize award.

In order to provide both efficient and timely receipt and recording of home audience participants and their number set selections, pre-registration of participants is preferred. In this way, each participant will receive instructions for playing the game as well as receiving a unique identifying code which will be easily recognized by the receiving station as indicating that particular person. Once identified, the caller transmits his particular number set selection and is automatically entered into the contest.

In the preferred embodiment, the home audience participation is achieved completely electronically, with the participant using a digital or tone-generating key pad. In this way, speed and accuracy are optimized. Preferably, the home participant will call the pre-advertised number and transmit his personal identification code upon hearing the requisite signal. Then, once notified by the receiving station that his code has been received and recognized, the caller activates the telephone keypad to transmit his selection for a winning number set. A call complete signal is then generated and the call is terminated.

Although any desired arrangement can be made for enabling a home viewer to call the receiving station, the preferred embodiment employs a "900" number. In this way, both the cost of the call and the expense of operating the system can be distributed over the price charged for calling the receiving station. In addition, this method also eliminates crank callers or constant repeat callers who could otherwise tie up the receiving station's ability to efficiently process the maximum number of calls.

Furthermore, the interactive communication system of this invention is also employable for enabling individuals to actively participate in any future event having multiple possible outcomes by attempting to predict, in advance, one specific outcome. In this way, individuals can enter any lottery of any state or wager on sport events, such as horse racing, wherever such wagering is legal.

In an alternate embodiment of this invention, the studio game show is based upon the contestants' ability to answer questions regarding a randomly selected topic or a pre-determined central theme. In its preferred embodiment, all of the questions asked relate to randomly selected countries of the world. In addition, each possible country in the pool of countries is listed on a highly visible display board, with a unique identifying number associated with each country.

During the first phase of the on-camera studio show, two or more contestants compete to earn money or prizes by answering questions regarding randomly selected countries of the world. When this phase is complete, the contestant with the highest points or dollar winnings competes in a championship round.

In this championship phase, six countries are simultaneously selected and questions regarding each country are asked. If successful in answering all of the questions, the contestant is the grand prize winner.

In order to enable the studio audience to participate in this embodiment of the invention, each audience member is allowed to complete a game card on which six numbers are selected from the total pool of numbers corresponding to the total number of countries in the contest. Any audience members who correctly select the six numbers corresponding to the six countries selected in the championship phase are winners and receive a pre-determined prize or share of the pre-determined jackpot.

In a similar manner, as detailed above, the home audience is also able to actively participate in the game show and share in the prizes being awarded. Preferably, the home viewers participate by calling a pre-advertised number to have their six number choice for the final six countries recorded in advance of the show. Any viewer who correctly predicts the final six countries receives or shares in the pre-determined prize award.

The invention accordingly comprises the several steps and relation of one or more such steps with respect to each of the others, with this system embodying features of construction, combination of elements and arrangement of parts which are adapted to effectuate such steps and interact therewith, all as exemplified in the following detailed disclosure, and the scope of the invention will be indicated in the claims.

THE DRAWINGS

For a fuller understanding of the nature and objects of the invention, reference should be had to the following detailed description taken in connection with the accompanying drawings in which.

DETAILED DESCRIPTION

In the interactive game show system of the present invention, three separate and distinct levels or types of active participation are provided. In particular, the conventional, limited group of on-camera participants are provided. However, in addition, all studio audience members and all home viewers are able to actively participate in the game and be eligible to win prize awards. Furthermore, as is detailed herein, the interactive communication system of this invention, which enables the home audience participation, is also usable to allow individuals to actively participate in any future, uncontrolled event having a plurality of alternate outcomes.

Dealing first with the game show system of the present invention, a plurality of contestants compete with each other before a live studio audience in order to win money and prizes. In this invention, the game show is based upon the random selection of a set of numbers from a substantially larger number pool, in the manner similar to conventional lottery games. Although the number pool may comprise any desired quantity of numbers, it has been found that a number pool of 54 numbers, with each being sequentially arranged, provides a preferred number pool.

Figure 1:
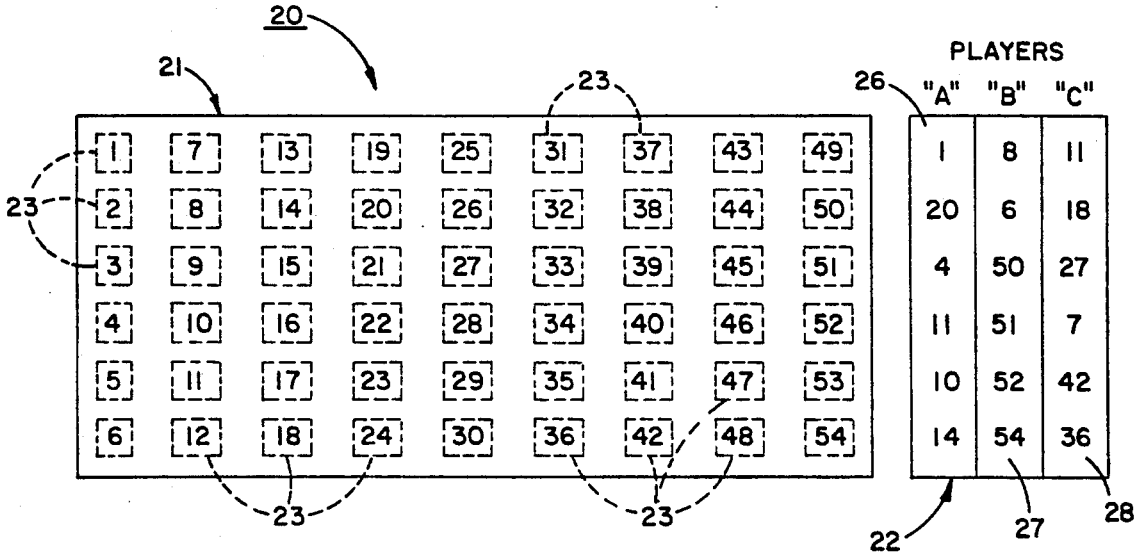
FIG. 1 is a schematic view showing the game board for use in the interactive game show of the present invention.

In FIG. 1, the preferred embodiment of game board 20 is shown. In this embodiment, game board 20 incorporates a first display panel 21 wherein the entire number pool is shown. As depicted in FIG. 1, display panel 21 of game board 20 incorporates 54 independent zones 23, each of which displays a unique number. In addition, a second display panel 22 is also provided wherein the number set selected by each contestant is clearly provided.

In the preferred embodiment, three on-camera contestants compete with each other by answering questions as they attempt to earn the particular set of numbers which the player hopes will be the final, randomly-generated, grand prize winning number set. Preferably, six independent numbers represent the number set and each player attempts to select a number set which will correspond to the game show generated number set.

During the competition phase of the game, which is more fully described below, each contestant, in a predetermined rotation, selects one number which that contestant wishes to become a part of his personal set of numbers.

As shown in FIG. 1, display panel 22 of game board 20 comprises player zone 26 in which the numbers earned by contestant "A" are displayed, while player zone 27 displays the numbers of contestant "B", and player zone 28 displays the numbers earned by the contestant "C". Although it has been found that employing three on-camera contestants, with each selecting a number set of six independent numbers is preferred, any other variation can be employed without departing from the scope of the present invention.

In order for each player to earn a desired number and have that number placed in that contestant's player zone as one of his number set, a player picks the number from display panel 21, and is required to answer the question hidden in zone 23 behind that particular number. If the player correctly answers the question, that number is then illuminated in the appropriate player zone of display panel 22. For example, if contestant "A" selects the numeral "1", a question will be displayed in zone 23 behind numeral "1". Once this question is properly answered by contestant "A", the numeral "1" will be displayed in player zone 26, as shown in FIG. 1.

In order to enable each player to earn prize awards during this active competition phase of the game show of the present invention, each of the numerals in display panel 21 of game board 20 would also have a particular prize award associated therewith, with the prize being displayed before the question is revealed.

In the preferred embodiment, dollar values ranging between about $100 and $1000 are employed as the prizes. In this way, when contestant "A" selects numeral "1" for adding the numeral "1" to that player's number set, display zone 23 would first show a dollar value which contestant "A" will earn if the question is properly answered.

In order to allow the contestants to select identical numbers, if so desired, all questions are changed after the question has been properly answered by a previous player. In this way, each contestant will have the ability to select any desired numeral, even if that numeral has been previously selected by another contestant.

If desired, questions can be changed each time a question is displayed, even if that question is not correctly answered. Alternatively, if a previous contestant fails to properly answer a question, it may be desirable to keep the question available for a subsequent contestant to select that number, in order to earn the prize money associated therewith if that contestant believes he knows the correct answer.

In order to further heighten interest in the game and allow each contestant to generate substantial prize money during the competition portion of the game, the preferred embodiment of the game employs a prize multiplier each time a contestant successfully answers a question. In one embodiment, the prize multiplier advances and increases with the player's success, with either the prize money for that question or the player's total earnings doubling when the player successfully answers his second question, and tripling when the player answers his third question. Preferably, this pattern continues throughout the competition phase, so that in the last round, the prize money for each question or each player's prize earnings are multiplied by six when the player successfully answers his sixth and final question.

Alternatively, prize multipliers can be hidden throughout the game board, in association with some or all questions, and revealed after a contestant selects a desired number. In this embodiment, the entire accumulated earnings of the player would be multiplied by the multiplying factor displayed or, alternatively, the particular dollar value hidden behind the multiplier is multiplied by that factor. In this way, additional excitement and interest can be generated, particularly by employing multipliers ranging between two and twenty-five. Depending upon the number of multipliers employed and the value of the multiplier factor, either the question value or the entire player's accumulated prize money can be selected for such prize multiplication increase.

Once one or more contestants have answered six questions correctly and have established their desired number set, the final, grand prize winning number set is generated. In the preferred embodiment, if two or more contestants have each correctly answered six questions and have complete number sets, the player having accumulated the most prize money is selected to participate in the final, grand prize number set selection.

In addition, the grand prize number set employed for determining whether or not the participating contestant succeeds in winning the grand prize is also employed as the number set upon which the home viewing audience and the studio audience winners are determined. In this way, excitement and interest in the entire show is enhanced. Furthermore, in order to maximize excitement and interest, separate prize pools are established for the home audience winners and the studio audience, in addition to the on-camera contestants' prize pool.

In the preferred embodiment, the grand prize winning number set is selected using random number generating equipment similar to the equipment employed in selecting winning lottery numbers. Typically, these winning numbers are obtained by having a set of identical balls with each having a unique number printed thereon, and placing the balls in a single container, with the container being rotated for mixing. Then, the equipment randomly selects a single ball, typically by vacuum, drawing the various numbered balls to the top of the container for identification and recording. In this way, the first six numbers drawn from the pool of numbers represents the winning number set which forms the basis for all prize awards for the particular day's version of the game show.

In view of the statistical probability that the winning on-camera contestant will have selected a number set which is not identical to the number set generated during the grand prize number selection, the game show of the present invention comprises a procedure for enabling the otherwise winning contestant to also win the grand prize award. Depending upon the particular system desired, this procedure can be accomplished in various equally efficacious ways.

In one embodiment, the on-camera contestant is required to answer six additional questions, each of which are hidden behind the six winning numbers generated during the grand prize number selection. If all six questions are correctly answered, the on-camera contestant is the grand prize winner and is awarded the previously stated high value grand prize award.

In an alternate embodiment, the on-camera contestant is required to answer only the questions behind those numbers which are not found in the set of numbers that contestant has earned during the game. In this way, each identical number in the contestant's number set which corresponds to an identical number in the grand prize winning number set, the player is automatically credited with having established that number, and needs only to answer the questions hidden behind the numerals appearing in the winning number set which are not present in the contestant's number set. In this way, a winning contestant may have to answer as few as one question or as many as six questions. If and when the required number of questions has been correctly answered, that contestant is the winner of the grand prize award.

In regard to the active participation of the studio audience, each studio audience member is allowed to complete an entry card which is collected prior to the start of the game show or, at least, prior to the selection of the grand prize winning number set. Each card submitted by a studio audience member will have indicia identifying the audience member as well as that individual's selection for the winning number set.

If the grand prize number set generated at the end of the game show corresponds identically to the number set submitted by one or more studio audience member, that audience member wins the predetermined audience prize award. Depending upon the value of the prize award, identical prize awards can be given to each successful audience member or can be shared by the plurality of audience members, if any, having selected the identical number set.

In order to enable home viewers to interactively participate in the televised game show, an interactive communication system has been developed which allows each home viewer to use a conventional telephone to identify himself and the particular six numbers representing that individual's personal selection for his number set. Each home participant would identify himself, using a unique code or numeral sequence, such as the individual's social security number.

In this way, the receiving station would obtain a specific individual identifier, as well as a particular six number set for each participant. In addition, each participant independently selects a personal desired winning number set with full confidence that the game show producers are incapable of controlling the outcome of the randomly generated grand prize winning number set, which is obtained using well-known conventional equipment. In order to further assure the honesty of the selections of a winning number completely at random, the equipment and selection process can be monitored by independent agencies.

In order to defray the expense of the central processing equipment and prevent individuals from purposefully flooding telephone lines to prevent other participants from entering the contest, the preferred embodiment of the present invention employs a "900" number for the telephone number participants to call in order to enter the game show contest. In this way, using standard practice, each individual making a telephone call to participate in the game show prize award would bear a pre-determined and pre-advertised expense, a part of which would be paid to the game show producers.

Furthermore, if desired, pre-registration of contestants can be employed in order to expedite the identification process and provide each caller with a clear set of rules and preferred timing for receipt of phone calls. The registration process, if employed, also enables a potential contestant to request an identification number, which would be provided by the game show producers. In addition to providing a unique, easily generated identifying indicia, which the user would employ in all telephone calls, the available telephone numbers and operational times would also be provided to the home viewer.

As is typical with most game shows, some, if not all, of the home viewers receive the televised broadcast on a taped delay. As a result, each participant must be aware of the taping schedule employed by the game show producers, so that their entry into each desired game show performance can be properly effectuated. As a result, by having a pre-registration process, both the individual identifying indicia can provided and a complete schedule to assure that any individual can actively participate in the game show whenever desired.

Of course, if the game show is to be televised as a live performance in any particular location, this information would also be provided to the home viewer, so that the preferred timing schedule for assuring that individual's entry into the contest can be effectuated in an orderly manner, thereby assuring that all desired entries are received and efficiently processed.

Figure 2:
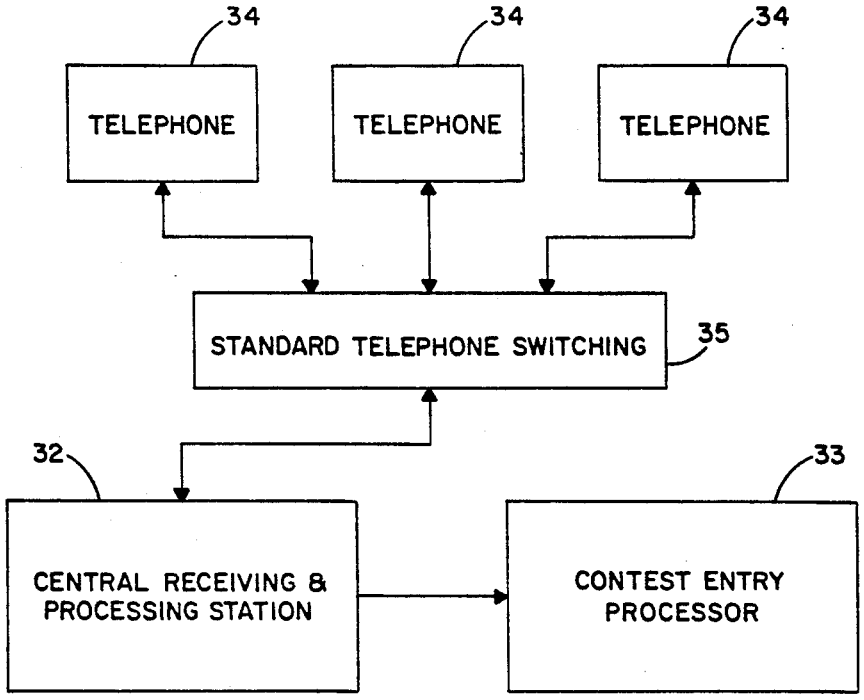
FIG. 2 is a diagrammatic view showing the interactive communication system employed by the home audience for interactively participating in the game show or any other event.

In FIG. 2, the preferred embodiment for the interactive communication system of the present invention is detailed. As shown therein, interactive communication system 30 comprises a central receiving and processing station 32 which communicates directly with a contest entry processor 33. In this way, the contestant identification indicia and the unique number set for each contestant is received and recorded by processing station 32. At the appropriate, desired time, all of the information received by central processing station 32 is transmitted to contest entry processor 33, in order to allow all of the telephone callers to be officially entered into the contest. Once received, contest entry processor 33 stores the information received and, subsequently, compares the final randomly generated grand prize winning number set of that particular performance of the game show with the number sets entered by the telephone callers for this particular show.

Contest entry processor 33 determines each and every winning contestant who has selected a number set identical to the grand prize winning number set and provides the information to the show producers. Preferably, the existence of a winner and the identity of that winner is provided to the viewing audience as part of the televised show, thereby adding to the excitement and interest in the show.

If desired, the function provided by contest entry processor 33 can be incorporated into control receiving and processing station 32. In this embodiment, the winners are determined by processing station 32 and the game show producers informed, at the end of the comparative analysis, the identify of any winners.

In the preferred embodiment, each individual home contestant desiring to participate in winning a prize award would employ a telephone 34 in order to enter the game contest. As depicted in FIG. 2, a plurality of telephones 34 are connected to standard telephone switching equipment 35, with switching equipment 35 being connected to the central receiving processing station 32. In this way, each home contestant is able to transmit the desired information to central receiving and processing station 32.

In the preferred embodiment, as mentioned above, home contestants employ a "900" telephone number in order to connect the home contestant with central receiving and processing station 32. In addition to efficiently achieving the interconnection of the individual with central receiving and processing station 32, standard telephone switching equipment 35 also records and bills the caller for a predetermined fee. A portion of this fee is provided by the telephone company to the game show producers. In this way, the expense of the development and operation of the processing equipment is partially absorbed by the contest entrants.

In addition, by requiring each contestant to pay a predetermined minimum entry fee as a telephone call expense, the game show producers are assured that crank callers are eliminated since, such crank callers will be required to pay for each telephone call made. Any individual desiring to enter a plurality of different number sets is able to do so, but is required to pay for each individual entry. Consequently, by charging each individual for entering the contest with a single number set, any abuse of the equipment by repeat callers is virtually eliminated.

By employing the interactive communication system of this invention, individuals are now able to actively participate in a televised game show in a manner which provides assurance and confidence that each individual has an equal chance of winning prize awards and that the outcome upon which the award is based is completely outside of the control of the game show producers.

In addition to establishing an interactive communication system which allows home contestants to actively participate in a televised game show, with confidence and assurance that the producers are incapable of controlling the final outcome which determines the prize award winners, the interactive communication system of this invention is also employable in a plurality of alternate contest situations. By employing interactive communication system 30, a home contestant can enter any desired lottery in any desired state, or wager on the future outcome of any sporting event, such as horse racing, boxing, football, etc. Of course, any such sport event wagering would only be effectuated in areas where such wagering is legal.

In order to enable a home contestant to enter any desired future contest having a plurality of outcomes, central receiving and processing station 32 is programmed to receive identifying indicia designating the particular event in which the home participant seeks to participate, as well as billing information, such as a credit card number, so that any desired wager or lottery expense can be immediately and efficiently processed and collected. In addition, a contest entry processor 33 is also required to determine any winning entrants and provide the required notification to the contest sponsors or agent for paying winners.

By employing the interactive communication system defined and described herein, individuals are able to participate in any desired future contest or event in the hope of properly selecting one of the plurality of outcomes of the event and winning the prize award associated with an accurate prediction. In addition, by employing the system of this invention, speed and efficiency are provided and individuals are now able to participate in events, where such participation was either difficult or impossible.

In the second embodiment of this invention, another interactive game show is provided wherein on-camera participants, studio audience members and home viewers all have a unique opportunity for direct participation. In this embodiment, a single topic, subject, or central theme is employed as the basis for the questions being asked. If desired, the topic or theme could be altered from one week to the next, or maintained as the sole central theme from week to week. The only requirement is that the theme or topic comprises a subject wherein a plurality of separate and distinct categories exist, with each category being sufficient to support the generation of a plurality of challenging questions.

In carrying out the studio portion of this embodiment of the present invention, each of the available categories which exist as part of the central theme are prominently displayed in the studio audience in a simple list, with each category having a unique indicia or numeral associated therewith. Preferably, the list of categories would be presented alphabetically, or in some other convenient arrangement, with each of the categories being identified by a unique numeral in ascending order.

During the on-camera studio game performance, one particular category from the list of available categories is randomly selected in order to initiate the play of the game. Any desired method can be employed for the selection process. However, total random selection should be assured. Once a category is selected, questions will be asked of one of the participants relating to that category until the next category is selected.

In carrying out this invention in a manner which provides a fast, exciting and challenging game show, it is preferred that the central theme comprises all of the countries in the world. In this way, each country represents a separate category from which numerous questions can be generated on a continuing, week-to-week basis, while also assuring that the sophistication level required to answer the questions remains high and challenging.

In order to best understand this embodiment of the invention, the following detailed disclosure is provided for the implementation of the present invention employing the countries of the world as the central theme. It is to be understood that this detailed disclosure is provided for exemplary purposes and is not intended, in any way, to limit this embodiment of the invention to this single theme.

In employing this central theme of "global intelligence", it is preferred that three on-camera contestants be selected for competing in the studio game. Preferably, these individuals are selected based upon a pre-telecast screening where each individual has proven to possess the ability to answer a wide range of questions on various countries in the world.

In this embodiment, all three contestants appear on stage simultaneously, with one contestant having been pre-selected to start the game play. The game play is initiated by having the pre-selected contestant determine which country of all of the available countries is to be used as the basis for the questions to be asked.

Figure 3:
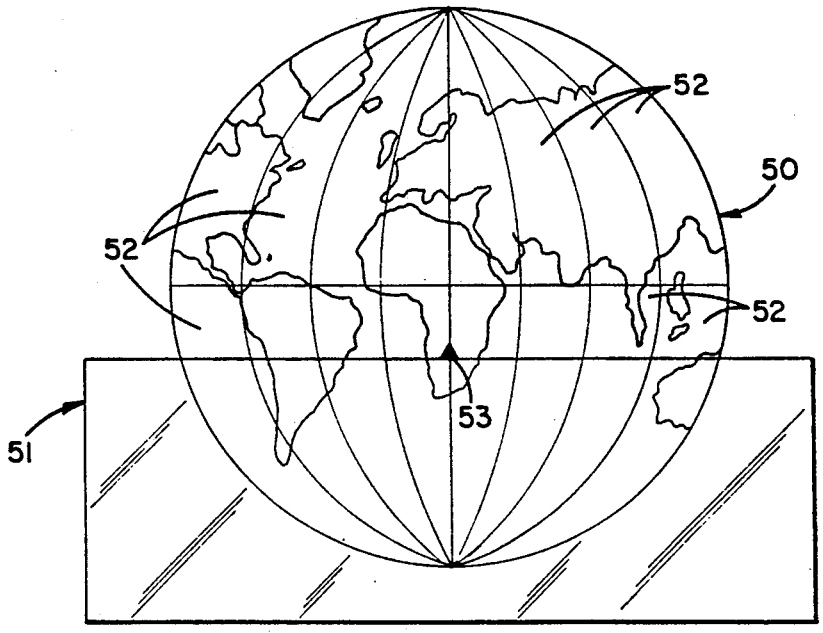
FIG. 3 is a plan view of a rotatable globe for use in an alternate embodiment of an interactive game show of the present invention.

Although a variety of alternate methods can be employed for this selection process, it is preferred that an enlarged globe, capable of being spun in any direction, be employed. In FIG. 3, one embodiment of such a globe is shown.

In this configuration, enlarged globe 50 is supportingly mounted in base 51, which allows globe 50 to be rotated in any desired direction. In addition, base 51 incorporates a pointer 53, which is positioned for high visibility and ease of recognition by the players and the audience.

Globe 50 is divided into a plurality of zones 52, each of which cover a substantial portion of the globe. As depicted in FIG. 3, globe 50 is divided into thirty-two equal zones, with sixteen zones existing in the Northern Hemisphere and sixteen zones existing in the Southern Hemisphere. If desired, the countries of the world can be drawn to scale, as generally represented in FIG. 3. Alternatively, if desired, the countries can be drawn in an exaggerated, non-scale form, in order to provide greater coverage of the globe by land mass, as opposed to the actual ratio of land to water. Of course, any number of zones can be employed as well as using zones of different sizes or dimensions.

In order to initiate the play of the game, the pre-selected contestant spins globe 50 relative to housing 51. If desired, an electronic program can be employed to assure that globe 50 rotates in a plurality of planes prior to coming to rest. Once the spinning of globe 50 has ceased, pointer 53 will be positioned in one particular zone 52.

Once a particular zone 52 has been chosen by pointer 53, a map of that zone appears on a large screen. In addition, all of the countries located in that zone are listed in alphabetical order, along with their identifying numeral. The contestant who has spun the globe is then given the chance to select, by its identifying number, the particular country to which he wishes to have the questions relate.

Figure 4:
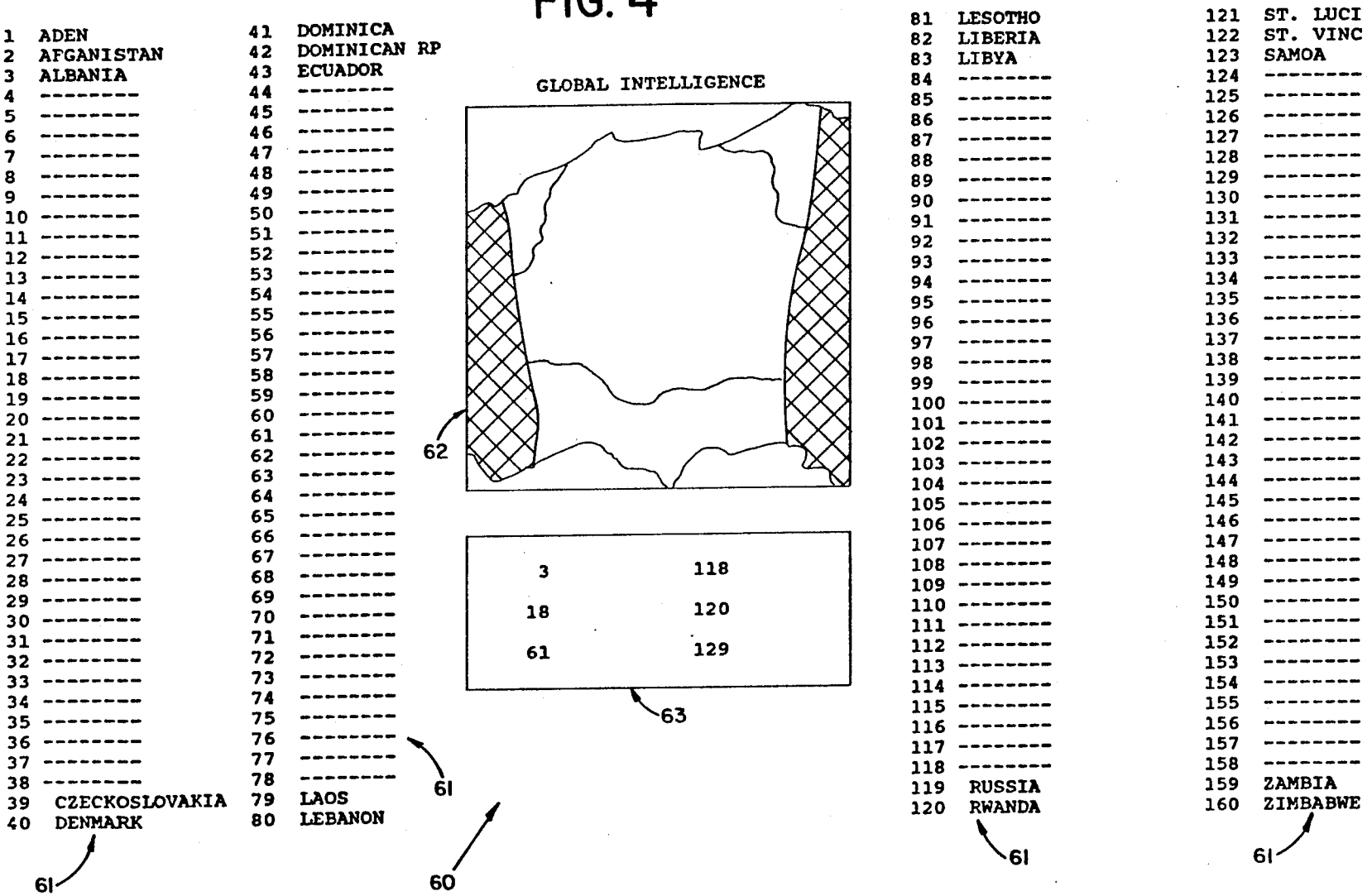
FIG. 4 is a schematic view of a game board for use with the alternate embodiment of the inactive game show of the present invention.

Preferably, a display panel or game board 60 is employed, as shown in FIG. 4. In this embodiment, game board 60 comprises a plurality of display columns 61 which list all of the countries of the world, in alphabetical and numerical order. In addition, game board 60 also incorporates a large screen portion 62, which is employed to show maps and interesting information about selected countries.

When a zone is selected by the spin of the globe, all of the countries in that zone are illuminated and the particular country selected by the contestant for the next question preferably blinks. In this way, the studio audience and the home viewers are immediately aware of the subject being employed in the game.

Once a country is selected, the game show host moves the play along by asking questions regarding that country. If the contestant answers correctly, he can continue with questions about that country or other countries within the selected zone.

Preferably, a maximum of six questions are asked about the countries in a particular zone. In addition, the degree of difficulty as well as prize value increases for each of the six questions as the questions are successfully answered. If the first contestant answers all six questions correctly, the next contestant spins the globe and answers questions in a manner similar to the first contestant.

Should there be a miss, prize value is deducted from the prize winnings of that contestant, and the next contestant is given the option of either answering questions regarding the countries in the zone in play or taking the opportunity to spin and find a new zone. As each country is selected, a map of that country and an interesting fact about that country preferably appears on screen 62.

In order to further heighten excitement and interest in the studio game, additional features, such as prize multipliers, special awards, etc., may be incorporated into the question and answer rounds. In addition, if desired, the questions can be limited to particular categories, such as sports, foods, heritage, etc., with all questions about the selected country being limited to the selected category.

In one example of this embodiment, ten categories are employed for the show and are displayed on a screen or board, with six different prize levels being listed below each category. Each contestant, in turn, selects an available category and prize level from the list. Preferably, all questions for the first round are based on the selected three categories.

In addition to selecting the categories, the contestant is asked to spin the globe, to select the country on which the questions in the category areas will be based. Once the country and categories have been established, each contestant, in turn, is asked questions corresponding to a selected category and prize value. Questions have varied degrees of difficulty corresponding to the associated prize value. Consequently, if prize values ranging from $100 to $600 were used, the $100 question in each category would be the easiest, while the $600 question would be the hardest.

Preferably, each contestant is asked six questions. If all six questions are answered correctly, the next contestant spins the globe to select a new country. If there is a miss, another contestant can volunteer to answer that question.

Preferably, no prize money is deducted for an incorrect answer during a contestant's normal play. However, a volunteered answer carries risk/reward by paying double the listed prize money for a correct answer, while counting as a double prize deduction for an incorrect answer.

If desired, the game play can be segmented into two or more rounds, with the prize value of each answer changing from one round to the next. In addition, other categories can be selected from the available list, thereby requiring a broader range of knowledge by each contestant.

Furthermore, the rounds can be distinguished by using different globes for each round, thereby emphasizing any particular area or region of the world. One way this arrangement may be implemented is to use a globe showing only the continents in the first round, with the questions being based upon the continent randomly selected. The second round would then be played, as detailed above, with the countries of the world depicted on the globe.

Preferably, after two rounds are played, the contestant with the highest prize total will be declared the champion. He will then have the opportunity to play the championship round for a large prize of cash or merchandise.

In the preferred embodiment, the championship round is based upon a fixed number of questions, such as six, each of which relate to countries in separate and distinct zones. Preferably, all six zones and all six countries are selected before any of the questions are asked. However, if desired, an alternate sequence can be followed.

Figure 5:
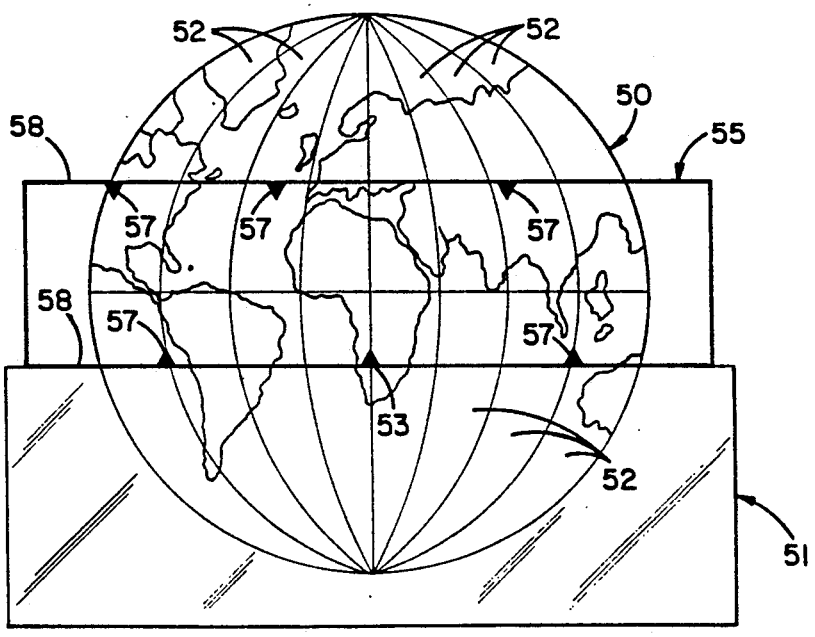
FIG. 5 is a plan view of the rotatable globe of FIG. 3 depicted for use in the championship round of the game show.

In order to allow globe 50 to be easily employed in the championship round, globe 50 in base 51 is fitted with a multiple pointer construction 55, as shown in FIG. 5. Globe 50, as detailed above in reference to FIG. 3, is securely supported in base 51. However, in order to enable the six separate zones to be simultaneously selected, pointer support member 55 cooperating engages and is supportingly mounted to base 51 peripherally surrounding globe 50. In addition, pointer support system 55 incorporates five additional pointers 57, each of which are spaced apart on support bars 58 of pointer support means 55.

As depicted in FIG. 5, additional pointers 57 are spaced apart from each other, as well as original pointer 53 in order to assure that each will land in a separate zone 52 of globe 50, after globe 50 has been spun and comes to rest. Once the championship round has been initiated by the champion spinning globe 50, pointers 57 will identify six separate and distinct zones 52, once globe 50 comes to rest.

Dealing with each selected zone individually, the champion will review the list of countries which exist in one of the selected zones and then, using the identifying numeral, select a single country in that zone about which he wishes to have one question asked. This process will then be repeated for each of the five remaining zones, until six countries have been selected from the six zones for becoming the subject of the six separate questions.

In addition, as shown in FIG. 4, display board 60 also incorporates a separate display panel 63 on which numerals are illuminated. Each of the numerals depicted in panel 63 of FIG. 4 represents one of the countries selected by the champion during the championship round. In this way, by using the identifying numeral depicted in panel 63, the studio and home audience can quickly scan the list of countries found in columns 61 employing the reference numeral in order to know which of the six countries the champion has selected and in which he will be answering questions. Preferably, each of the six selected countries are illuminated during the championship round, with the country about which the questions are being asked shown by blinking the lights on and off.

In the preferred embodiment, if the contestant correctly answers all six questions within the allotted time, the contestant is declared the winner of the championship round. Suitable prizes or monetary awards are then accorded this individual. In addition, if desired, the daily champion can be invited to return to the next show for a try at winning additional prizes or for competing in a grand prize contest wherein higher value prize awards are given.

If the contestant fails to correctly answer any of the six questions during this championship round, he would still be entitled to take home all of the prizes and monetary awards he has obtained up to that time.

In regard to the active participation of the studio audience, each studio audience member is allowed to complete an entry card which is collected prior to the start of the game show or, at least, prior to the championship round. Each card submitted by a studio audience member will have indicia identifying the audience member as well as that individual's selection of the six numbers which will represent the six countries selected by the contestant in the championship round.

If the six numbers resulting from the contestant's country selection in the championship round corresponds identically to the six numbers submitted by one or more studio audience member, that audience member wins the predetermined audience prize award. Depending upon the value of the prize award, identical prize awards can be given to each successful audience member or can be shared by the plurality of audience members, if any, having selected the identical number set.

In order to enable home viewers to interactively participate in the televised game show, the interactive communication system detailed above is preferably employed to allow each home viewer to use a conventional telephone to identify himself and the particular six numbers representing that individual's personal selection for the six final countries. In the same manner as detailed above, the receiving station would receive from the home viewer a specific individual identifier, and the particular six numbers selected by that participant as the numerals corresponding to the six countries selected in the championship round.

Using this concept, each participant independently selects a personal set of six numbers with full confidence that the game show producers are incapable of controlling the outcome of the randomly generated six numbers. Clearly, since the winning six numbers are obtained using the spinning globe and the personal country selection of the contestant, the possibility of controlled numbered selections is eliminated. If desired, in order to further assure that the winning numbers are selected completely at random, the equipment and selection process can be monitored by independent agencies.

In one embodiment, home viewers participate in the game show by phoning a pre-designated "800" number, preferably available 24 hours a day. Viewers make their selections for an upcoming show, utilizing a touch tone telephone and selecting (a) the game date (typically up to 24 hours prior), (b) the proposed numbers of the six countries and (c) a unique personal identifying number, such as one's Social Security Number. The computer will record this data as well as the telephone number called from, in order to assure ease of tracking the winners. All home viewers selecting six numbers which match all six numbers of the countries selected in the championship round of the date played, will be declared winners and will be awarded the pre-designated prize or share in that prize with other winners.

In order to defray the expense of the central processing equipment and prevent individuals from purposefully flooding telephone lines to prevent other participants from entering the contest, the preferred embodiment of the present invention employs a "900" number for the telephone number participants to call, in order to enter the game show contest. In this way, using standard practice, each individual making a telephone call to participate in the game show prize award would bear a pre-determined and pre-advertised expense, a part of which would be paid to the game show producers.

Furthermore, if desired, pre-registration of contestants can be employed in order to expedite the identification process and provide each caller with a clear set of rules and preferred timing for receipt of phone calls. The registration process, if employed, also enables a potential contestant to request an identification number, which would be provided by the game show producers. In addition to providing a unique, easily generated identifying indicia, which the user would employ in all telephone calls, the available telephone numbers and operational times would also be provided to the home viewer.

As is typical with most game shows, some, if not all, of the home viewers receive the televised broadcast on a taped delay. As a result, each participant must be aware of the taping schedule employed by the game show producers, so that their entry into each desired game show performance can be properly effectuated. As a result, by having a pre-registration process, both the individual identifying indicia and a complete schedule can be provided to assure that any individual can actively participate in the game show whenever desired.

Of course, if the game show is to be televised as a live performance in any particular location, this information would also be provided to the home viewer, so that the preferred timing schedule for assuring that individual's entry into the contest can be effectuated in an orderly manner, thereby assuring that all desired entries are received and efficiently processed.

In a further embodiment, home viewers can play the same game as the studio contestants by calling a special, advertised "900" number, identifying themselves as above. Then, the computer randomly selects six countries and a question for each country. All questions are the type of questions that can be used for upcoming shows, with each series of questions preferably including at least one which would be considered to be most difficult. In this way, a challenging and fun-filled telephone contest is achieved.

The questions are structured for multiple choice answers and five seconds are allotted for each answer. All six questions must be answered correctly to constitute a win. Furthermore, a large universe of questions is utilized and is constantly rotated randomly by the computer to eliminate the chance of one caller repeatedly calling and getting the same question.

Preferably, players in each game play for a large cash prize, such as $25,000, with winners of the "900" number game also qualifying to be studio contestants. If desired, the prize for the "800" number game is partially supported by a supplement from the "900" number game. In addition, prizes are progressive so that the prize grows if there is no winner. In this way, viewer interest grows as prizes grow and as entries grow, so does the prize.

Preferably, home participating winners are showcased on the studio game show. By interweaving the interactive show into the studio contest and by announcing winning numbers for home viewers and showcasing winners, viewer audience interest is maintained and heightened.

In addition to providing a game show suitable for television and enabling both the studio audience and home viewing audience to actively participate in the game show, the embodiments of this invention may also be employed as the basis for a home board game. Although either of the embodiments detailed above can be equally applicable to a board game construction, the embodiment incorporating a spinning globe or orb is particularly suitable for a board game in view of the visual and manual components incorporated into the game play.

Of course, as detailed above, a globe segmented into a plurality of zones or an orb having a plurality of segments or indicia marked thereon for selecting particular categories or subject matter would be employed as part of the board game, in order to establish the area of questioning. Once a country, a continent, or a subject area has been selected by rotation of the globe or orb, questions associated with the selected subject would be asked of the players, in the manner detailed above in reference to the studio game show. In this way, home excitement and competition can be achieved in an easily useable game wherein individuals having a broad-based knowledge of various subject areas or of the countries of the world would be able to compete with each other for fun and excitement. Certainly, if the embodiment of this invention with the countries of the world is employed for the home board game, the individual achieving the highest point total would certainly be declared as someone possessing global intelligence.

It will thus be seen that the objects set forth above, among those made apparent from the preceding description, are efficiently attained and, since certain changes may be made in carrying out the above process or in the construction set forth above, without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statement of the scope of the invention which, as a matter of language, might be said to fall therebetween.

Having described my invention, what we claim as new and desire to secure by Letters Patent is:

1. A method for providing a televisable game show in which the home viewing audience and the studio audience are able to directly participate by having a chance to win prize awards, comprising the steps of:

A. selecting at least two contestants;

B. establishing a pool comprising a fixed quantity of unique indicia;

C. requiring each contestant to successively answer questions until one of said contestants is declared a winner;

D. randomly selecting at least one set of indicia for use in determining the questions the contestants are asked, said set of indicia comprising a predetermined, fixed quantity of indicia from the entire pool of indicia;

E. enabling studio audience members and home viewers to pre-select a personal set of indicia in advance of the random selection of the set of indicia from the entire pool of indicia; and F. awarding a prize to each participating studio audience member and home viewer having selected a personal indicia set which matches in its entirety the randomly generated indicia set.

2. The method defined in claim 1, wherein the indicia are further defined as comprising unique numbers each of which has a specific subject area associated therewith, and the game show contestants compete by answering questions associated with the subject area of randomly selected indicia.

3. A method for providing a televisable game show comprising the steps of:

A. establishing a principal theme having a plurality of separate and distinct categories;

B. separately identifying each category with a unique indicia;

C. selecting two contestants;

D. randomly selecting one indicia for determining the category upon which a question is to be based;

E. requiring one of the contestants to answer a question regarding the selected category;

F. repeating the indicia selection and question answering steps until a winner is declared;

G. randomly selecting a plurality of indicia and associated categories for a final bonus round;

H. requiring the winning contestant to answer a question for each of said plurality of randomly selected categories; and I. awarding a special high value prize to the contestant if all questions have been correctly answered.

4. The method defined in claim 3, wherein the randomly selected plurality of indicia and categories of the bonus round comprises a fixed, predetermined total number.

5. The method defined in claim 4, wherein said fixed, predetermined total number of indicia and categories ranges between about four and ten.

6. The method defined in claim 3, wherein said indicia is further defined as comprising a unique numeral associated with each of said plurality of categories.

7. The method defined in claim 6, wherein the plurality of numerals representing the categories randomly selected as part of the bonus round defines a set of numerals upon which interactive awards are based.

8. The method defined in claim 7, wherein members of the studio audience and the home viewing audience are capable of competing in winning prize awards by submitting, in advance, a personal set of numerals and awards are provided to all contestants whose sets of numeral selections correspond completely with the actual set of numerals selected during the bonus round.

9. The method defined in claim 3, comprising the additional steps of

J. establishing a highly visible game board displaying all available indicia and categories; and K. associating a prize award with each indicia and category, which prize award is won by the contestant selecting the indicia and category and properly answering the question associated therewith.

10. The method defined in claim 9, wherein said prize award is further defined as comprising a cash award.

11. The method defined in claim 10 comprising the additional step of

L. selecting for participation in the bonus round the contestant having earned the most prize money during the game play.

12. The televisable game show method defined in claim 3 wherein the studio audience is able to directly participate by having a chance to win prize awards, comprising the additional steps of J. providing each member of the studio audience with a game card of designating a personal set of indicia;

K. receiving and recording each studio audience selection for a personal indicia set; and L. awarding a pre-determined prize award to all studio members having submitted a personal indicia set which matches in its entirety the randomly generated indicia set of the final bonus round.

13. The televisable game show method defined in claim 3, wherein the home viewing audience is able to directly participate by having a chance to win prizes awards, comprising the additional steps of J. receiving and recording personal indicia set selections from home viewers;

K. comparing the personal indicia set submitted by each home viewer with the randomly generated indicia set of the final bonus round; and L. awarding a pre-determined prize to all contestants having entered a personal indicia set which matches in its entirety the randomly generated indicia set of the final bonus round.

14. The televisable game show method defined in claim 13, wherein said receiving and recording step is provided by computer means capable of receiving telephone calls from home viewers, thereby enabling the home viewers to actively participate in the game show by merely employing their telephones.

15. The televisable game show method defined in 14, wherein said computer means is further defined as comprising a. means for receiving individual identifying indicia via telephone transmission for identifying each individual caller, b. means for receiving and recording in association with each individual caller the particular contest-entering personal indicia set of the caller; and c. means for comparing the personal indicia set of each caller with the randomly generated, indicia set of the final round and identifying all individuals whose personal indicia matches in its entirety the randomly generated game indicia set of the final round.

16. The method defined in claim 3, comprising the additional steps of

J. classifying the plurality of categories into a smaller plurality of distinct groups;

K. providing random selection means on which all of the groups are displayed;

L. selecting a category by enabling the contestant to employ the selection means for randomly designating one of the groups displayed thereon; and M. allowing the contestant to select one category contained in the randomly selected group.

17. The method defined in claim 16, wherein the random selection means is further defined as comprising a movable panel member on which all of the groups are displayed for ease of recognition, with each group having an equal chance of being selected by movement of the panel member.

18. The method defined in claim 16, comprising the additional steps of

N. modifying the random selection means to enable a plurality of separate and distinct groups to be simultaneously selected, said plurality being equal in number to the plurality of categories required for the final bonus round; and O. allowing the contestant to select one category from each of the plurality of groups randomly selected in the preceding step, with each of the categories selected forming the basis for the questions to be asked of the contestant in the final bonus round.

19. The method defined in claim 18, wherein the principal theme comprises the world, the categories comprise the countries of the world arranged in alphabetic order, the unique indicia comprise a unique numeral associated with each separate and distinct country, and the random selection means comprises a globe containing all of the countries of the world divided into a plurality of equal sized groups.

20. The method defined in claim 19, wherein the globe is constructed to simultaneously designate six separate and distinct groups of countries for use in determining the questions for the final bonus round, with the winning contestant being allowed to select, by numeral designation, one country from each group, with each of the six selected countries representing the subject matter upon which the bonus round questions are based, with the six country designating numerals selected by the contestant representing the plurality of indicia upon which winning audience members and home viewer prizes are based.

* * * * *